United States Patent [19]

Etkins

[11] 4,126,847

[45] Nov. 21, 1978

[54] PASSIVE ACOUSTIC NAVIGATION AID

[75] Inventor: Robert Etkins, Crofton, Md.

[73] Assignee: Westinghouse Electric Corp., Pittsburgh, Pa.

[21] Appl. No.: 596,138

[22] Filed: Jul. 15, 1975

[51] Int. Cl.[2] ..... G10K 11/00

[52] U.S. Cl. ..... 340/5 R; 340/8 FT; 181/175

[58] Field of Search ..... 340/3 R, 8 FT; 181/175; 343/18 B, 18 C

[56] References Cited

U.S. PATENT DOCUMENTS

| | | | |
|---|---|---|---|
| 3,014,198 | 12/1961 | Harris | 340/8 FT |
| 3,195,677 | 7/1965 | Hillery et al. | 340/8 FT |
| 3,409,868 | 11/1968 | Salathiel | 340/3 R |

*Primary Examiner*—Richard A. Farley
*Attorney, Agent, or Firm*—D. Schron

[57] ABSTRACT

A corner reflector lined with resonant frequency determining hollow gas-filled spheres is interrogated with a plurality of frequencies, including the resonant frequency and the acoustic return is substantially only the resonant frequency. A four-quadrant device is provided and each quadrant of the device is lined with different sized spheres for four different resonant frequencies, and installed according to predetermined geographical coordinates and orientation. With the combination of resonant frequencies, the interrogating vessel can obtain directional as well as identifying information with respect to the device.

9 Claims, 11 Drawing Figures

PASSIVE ACOUSTIC NAVIGATION AID

BACKGROUND OF THE INVENTION

1. Field of the Invention

This invention in general relates to sonar reflectors, and particularly to a low cost passive acoustic target and navigational aid.

2. Description of the Prior Art

Various navigational aids have been devised for assisting submersible vessels in ocean bottom search and/or survey applications. Very often a large number of corner reflectors or transponders are laid out in a grid network so that with proper interrogating signals, the submersible vessel may get an indication of its location with respect to the grid. These devices may be laid out in a more extensive array to serve as navigational markers.

In the case of corner reflectors, however, the interrogating signal is returned to the interrogating vessel and is not individually indentifiable. The transponder, which is an automated receiver/transmitter is able to transmit a unique identifying signal when triggered by an interrogating signal, however the cost of providing transponders over an extensive navigational network becomes prohibitive and in addition, the transponders are active devices requiring power supplies.

SUMMARY OF THE INVENTION

The present invention is a relatively inexpensive passive device which provides distinctive echo characteristics for identification and/or navigational purposes.

As an identification device, a plurality of resonant frequency selective elements, such as gas-filled spherical membranes are arranged over three substantially mutually perpendicular surfaces, as in a corner reflector. When insonified with an interrogating signal, including the resonant frequency, the device will return substantially only the resonant frequency to the interrogating vessel.

Four sets of spheres may be arranged in four quadrants, with each quadrant having different diameter spheres representing different resonant frequencies to serve as a navigation aid. When the device is aligned along a predetermined orientation, the signal or signals returned to the interrogating vessel will provide an indication of relative bearing to the device. A plurality of such devices would be placed along a prescribed route to guide a vessel to its destination.

DESCRIPTION OF THE PREFERRED EMBODIMENT

Figure 1:
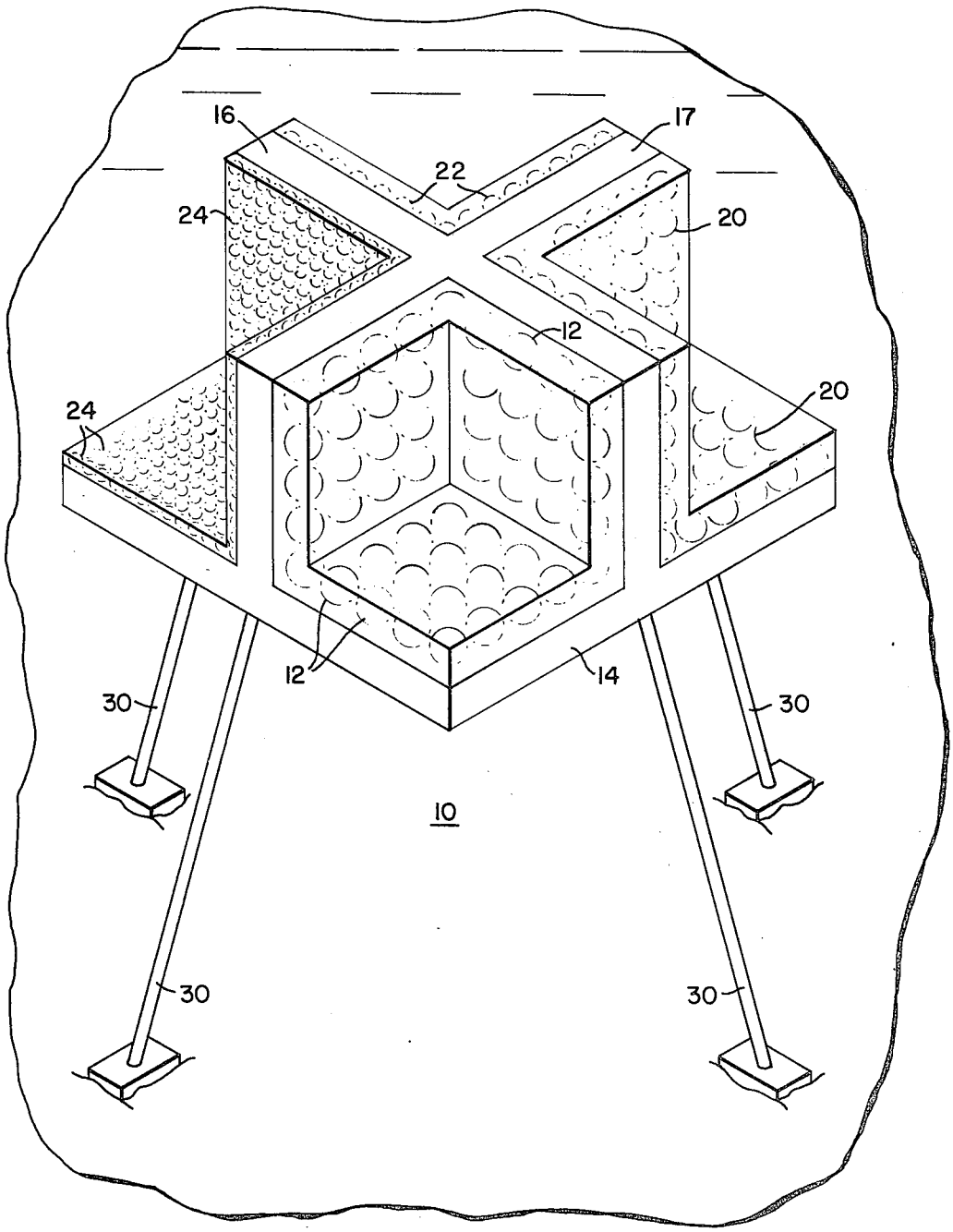
FIG. 1 is an in situ view of one embodiment of the present invention.

In FIG. 1 the navigation device 10 includes a plurality of frequency selective elements 12 each resonant at the same predetermined frequency. In a preferred embodiment, the device 10 is moored to the bottom of the body of water and the elements are gas-filled spherical membranes with the internal gas pressure thereof being equal to the pressure of the ambient water.

An interrogating vessel transmits an interrogating signal toward the device and in order to maximize the return, the plurality of elements 12 are preferably arranged as a corner reflector having three substantially mutually perpendicular faces. Base member 14 forms one surface while upstanding wall members 16 and 17 form the other surfaces.

When interrogated by an acoustic signal at the resonant frequency, the resonant elements 12 pulsate with large amplitudes when exposed to pressure variations due to the sound field. The mass of the surrounding water, in conjunction with the compressibility of the gas in the resonant element, results in a resonance at a certain frequency determined by the sphere diameter and the average pressure of gas in the bubble. If $f_r$ is the resonant frequency, then:

$$f_r = (44.6\, p^{1/2})/d$$

where $p$ is the pressure measured in feet of water and $d$ is the sphere diameter measured in inches.

In order to provide directional information to an interrogating vessel, the device includes a plurality of other groups of frequency selective elements 20, 22 and 24, each group being similar to the first group 12, however, with different diameters to be resonant at three respective other frequencies. The groups of elements 12, 20, 22 and 24 are arranged in four respective quadrants and the device is moored by means of a mooring system 30 in accordance with a predetermined geographic orientation.

Figure 2:
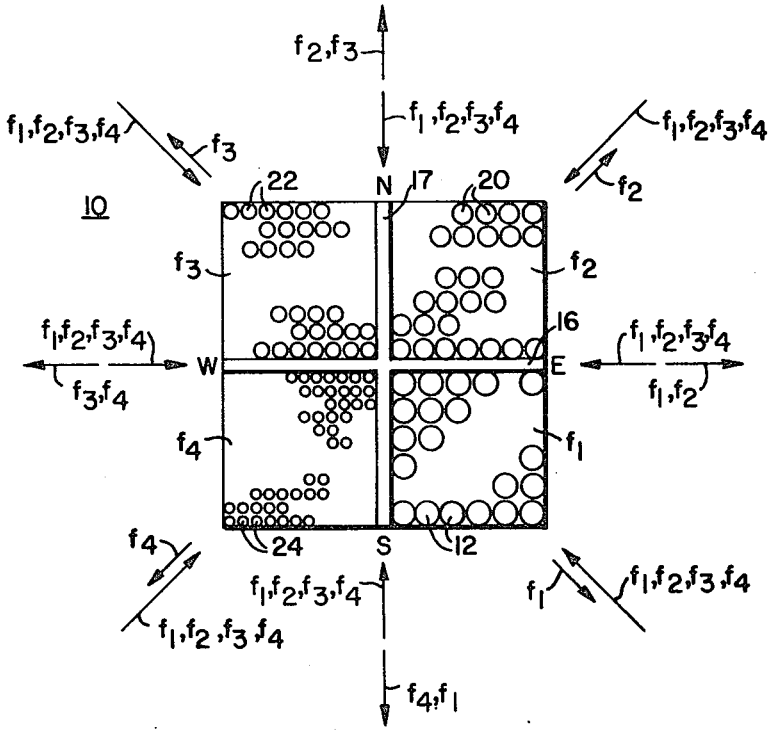
FIG. 2 is a plan view of the device of FIG. 1.

For example, FIG. 2 illustrates a plan view of the device 10 of FIG. 1 oriented such that the wall 16 is aligned along an east-west axis and wall 17 along a north-south axis. The four quadrants have been designated $f_1$, $f_2$, $f_3$ and $f_4$ respectively indicative of the resonant frequencies of elements 12, 20, 22 and 24. Since the resonant frequency is an inverse function of the sphere diameter, elements 12 having the largest diameter will resonate at the lower frequency $f_1$ and elements 24 having the smallest diameter will resonate at the higher frequency $f_4$.

The interrogating vessel will transmit an interrogating signal which includes all four resonant frequencies $f_1$ to $f_4$. By way of example let it be assumed that the interrogating vessel is located at a southeast bearing with respect of the navigation device 10. In response to the interrogating signal, substantially only a signal of frequency $f_1$ will be returned to the vessel by virture of the insonification of elements 12, resonant at the frequency $f_1$. If the bearing of the interrogating vessel is due east, signals of frequencies $f_1$ and $f_2$ will be returned in response to insonification by the interrogating signal of elements 12 and 20. Interrogation from a northeast bearing will result in a return signal of frequency $f_2$ while a due north bearing will return signals of frequencies $f_2$ and $f_3$. In a similar fashion, signals of: frequency $f_3$ will be returned along a northwest bearing; of frequencies $f_3$ and $f_4$ along a west bearing: of frequency $f_4$ along a southwest bearing and of frequencies $f_1$ and $f_4$ along a due south bearing.

Figure 3:
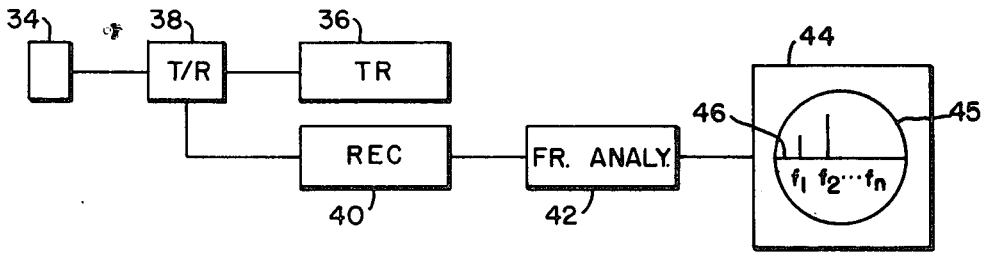
FIG. 3 is a block diagram illustrating one form of interrogating and receiving apparatus carried by an interrogating vessel.

The interrogation and interpretation of the return signal may be carried out in a variety of ways one of which is illustrated in FIG. 3. A transducer 34 projects an interrogating signal comprised of at least the four different frequencies $f_1$ to $f_4$, supplied to it by transmitter 36 through a conventional transmit/receive (TR) switch or circuit 38. The acoustic return comprised of one or more of the frequencies may be picked up by the same transducer 34 and provided, through the TR switch 38 to a receiver 40. Coupled to the output of the receiver 40 is a frequency analyzer 42 which analyzes the return signal with respect to the frequency components thereof and supplies these frequency components together with their amplitude value to a display 44 which may include a conventional cathode ray tube 45 having a frequency scale 46 on the face thereof. In one embodiment more than four different frequencies may be utilized and accordingly the frequency scale 46 goes from $f_1$ to some predetermined higher frequency $f_n$.

Figure 4:
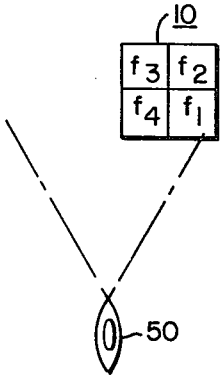
FIGS. 4–6 illustrate the relative bearing of an interrogating vessel and the device of FIG. 2 and FIGS. 4A–6A illustrate the respective displays therefor.
Figure 5:
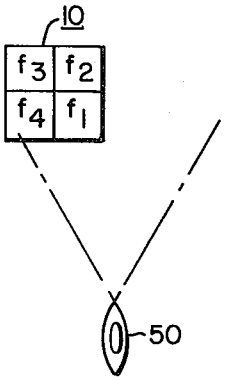
Figure 6:
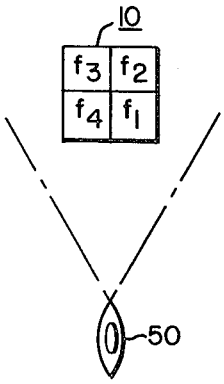
Figure 4A:
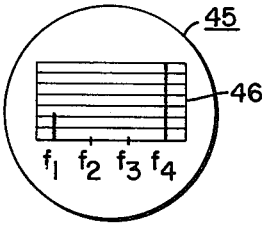

For the case of just four different frequencies, $n$ will be equal to 4, and a typical operation will be described with additional reference to FIGS. 4 through 6 illustrating three different relative bearings of a submarine interrogating vessel 50 with respect to the device 10. In FIG. 4, in response to a transmitted interrogation signal, the apparatus of FIG. 3, carried by the submarine 50 will receive signals of two different frequencies $f_1$ and $f_4$. With the submarine 50 to the left of the north-south track the return signal of frequency $f_4$ will be greater than that of frequency $f_1$. The display for such situation is illustrated in FIG. 4A indicating the presence of signals of freqency $f_1$ and $f_4$, however with the $f_4$ signal being of greater amplitude.

Figure 5A:
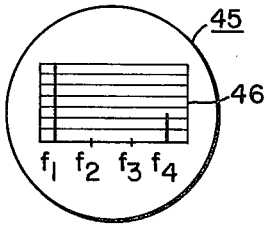

With the submarine 50 to the right of the north-south track as illustrated in FIG. 5, the display of FIG. 5A would indicate the presence of the $f_1$ and $f_4$ signals, however with the amplitude of the $f_1$ signal being the greater.

Figure 6A:
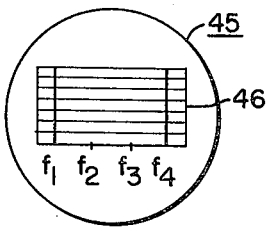

With the submarine 50 right on the north-south track, the frequency retun signals from the first and fourth quandrant will be of equal strength and accordingly the display, as illlustrated in FIG. 6A, will show the two signals of equal amplitude.

Figure 7:
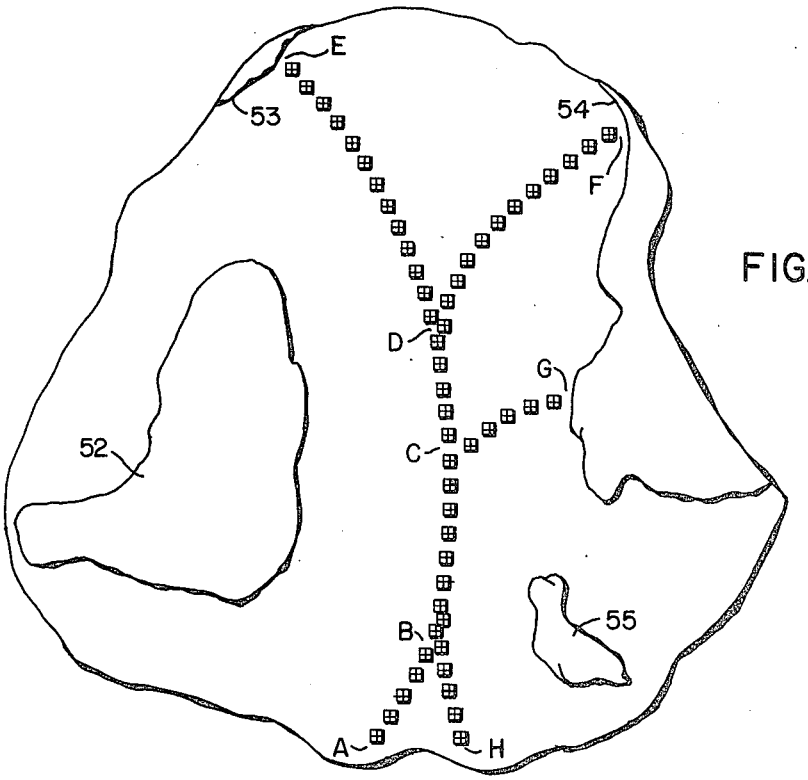
FIG. 7 illustrates a plurality of arrays of devices for navigational purposes.

A plurality of such navigational devices may be installed along a desired route, or routes, with their axes aligned with the earth's north-south and east-west axes or any other desired predetermined orientation relative to the route. Not only may a signal route be mapped out but by using a greater number of operating frequencies, a plurality of such routes may be followed, such as illustrated in FIG. 7.

A number of possible routes are illustrated in position relative to land masses 52 through 55. Such application finds particular utility in the case where stellar or radio navigation are hampered by degraded accuracy of inertial and magnetic reference, such as under the ice in the polar regions. A first string, A B C D E, of navigation devices may all be operable with freqencies $f_1$ to $f_4$ to define a first route. A second route, A B C D F, incorporates some of the devices of the first route and with possible different combination of frequencies for the route from D to F, although with wide enough separation between devices the same four frequencies could possibly be used. Another route utilizes the route from A to C and branches off to G and yet another route, from H, joins up with the previously described route at junction B. If different combinations of frequencies are utilized for different strings of devices, then the interrogating signal may incorporate all of these frequencies.

Figure 8:
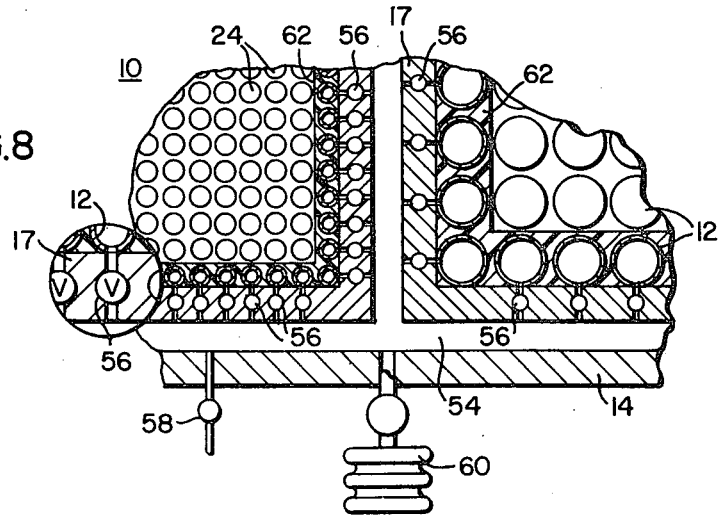
FIG. 8 illustrates a portion of the device in cross section demonstrating a method of maintaining spherical membranes at ambient pressure.

In the described embodiment, the frequency selective elements are gas-filled spherical membranes maintained at the ambient pressure of the surrounding water medium. One way of accomplishing this is to pre-charge these spheres to the proper operating pressure during their manufacture. Another method by which these spheres can be charged to any desired pressure and be maintained at that operating pressure during its lifetime, is illustrated in FIG. 8. A portion of the device 10 is shown in section and includes a portion of the first quadrant having elements 12, and a portion of the fourth quadrant having elements 24. A charging manifold 54 may be attached to or incorporated as part of the base 14 and may extend up into the walls such as 17. Each of the spheres 12 and 24 is connected to the manifold 54 by respective check valves 56 and charging to the proper pressure is accomplished by way of charging valve 58.

In order to prevent the spheres from being compressed during deployment, and to maintain them at substantially the ambient pressure there is provided a compensating bladder 60 connected to the charging circuit.

The structural portion of the navigational aid may be made from lightweight non-corrosive rigid material such as a fiberglass laminate which will not deteriorate in sea water. The resonant spheres are potted in an acoustically transparent, anti-fouling rho-c material 62 which forms a coating over the spheres and all mutually orthogonal plane surfaces. For the depolyment illustrated in FIG. 1, the structure would have a net positive buoyancy, or alternatively, non-acoustically reflective bouyant ballasting devices could be used.

I claim:

1. Passive acoustic navigation device comprising (A) a first set of frequency selective elements resonant at a first predetermined frequency arranged over three substantially mutually perpendicular surfaces to form a corner reflector;

(B) a plurality of other similarly disposed sets of said elements resonant at respective other predetermined frequencies;

(C) said sets being respectively arranged in four quadrants.

2. Apparatus according to claim 1 wherein:

(A) said elements are hollow spheres.

3. Apparatus according to claim 1 wherein:

(A) said device is buoyant and moored to the bottom of a body of water.

4. Apparatus according to claim 1 which includes:

(A) a plurality of said devices;

(B) said plurality being oriented along a desired navigational route.

5. Apparatus according to claim 2 wherein:

(A) said spheres are gas-filled; and which includes (B) means for initially charging said spheres to a predetermined pressure.

6. Apparatus according to claim 5 which includes:

(A) means for maintaining said spheres at a pressure substantially equal to the ambient pressure during deployment.

7. Apparatus according to claim 1 which includes:

(A) acoustically transparent potting material covering said elements.

8. Apparatus according to claim 4 which includes:

(A) at least another plurality of said devices defining an additional navigational route.

9. Apparatus according to claim 8 wherein:

(A) said another plurality of devices having frequency selective elements resonant at predetermined frequencies other than those of said first plurality of devices.

* * * * *